US007473188B2

(12) United States Patent
Nishino

(10) Patent No.: US 7,473,188 B2
(45) Date of Patent: Jan. 6, 2009

(54) PUTTER HEAD

(75) Inventor: Takumi Nishino, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 98 days.

(21) Appl. No.: 11/704,208

(22) Filed: Feb. 9, 2007

(65) Prior Publication Data

US 2007/0243951 A1 Oct. 18, 2007

(30) Foreign Application Priority Data

Apr. 17, 2006 (JP) ..... 2006-113460

(51) Int. Cl.
*A63B 53/04* (2006.01)

(52) U.S. Cl. ..... 473/340; 473/349; 473/350

(58) Field of Classification Search ..... None
See application file for complete search history.

(56) References Cited

U.S. PATENT DOCUMENTS 2,222,534 A * 11/1940 Harris ..... 473/248
4,121,833 A * 10/1978 Prueter ..... 473/330
4,529,202 A * 7/1985 Jacobson ..... 473/256
5,423,544 A * 6/1995 Ichikawa ..... 473/340
5,437,447 A * 8/1995 Rigutto ..... 473/251
5,683,307 A * 11/1997 Rife ..... 473/313
5,716,290 A * 2/1998 Baker et al. ..... 473/313
5,769,736 A * 6/1998 Sato ..... 473/335
5,782,706 A * 7/1998 DePriest ..... 473/341
5,830,078 A * 11/1998 McMahan ..... 473/252
6,267,689 B1 * 7/2001 Ambrose ..... 473/251
6,716,110 B1 * 4/2004 Ballow ..... 473/242
6,796,911 B2 * 9/2004 Grace ..... 473/251
6,893,355 B2 * 5/2005 Souza et al. ..... 473/251
6,926,615 B1 8/2005 Souza et al.
6,929,559 B1 * 8/2005 Grace ..... 473/251
6,929,560 B1 * 8/2005 Roshala et al. ..... 473/256
6,929,564 B2 * 8/2005 Olsavsky et al. ..... 473/340

(Continued)

FOREIGN PATENT DOCUMENTS

GB 2407779 A * 5/2005

(Continued)

*Primary Examiner*—Gene Kim
*Assistant Examiner*—Alvin A Hunter
(74) *Attorney, Agent, or Firm*—Birch, Stewart, Kolasch & Birch, LLP

(57) ABSTRACT

A head 2 has three regions, i.e., an anterior region Z positioned on the facemost side, a posterior region K positioned on the backmost side, and a joint region R positioned between the anterior region Z and the posterior region K, which are provided to divide the putter head equally in the face-to-back direction. The anterior region Z has an anterior thick part Z1 having a thickness of equal to or greater than 20 mm. The joint region R has a thin part 16 having a thickness of equal to or less than 7 mm. The posterior region K has a posterior thick part K1 having a thickness of greater than 7 mm. The joint region R has a full-width part 23 formed by making the full width of this joint region to correspond to the thin part 16. Provided that the length of the head 2 in the face-to-back direction is A1, the length of the full-width part 23 in the face-to-back direction is equal to or greater than (A1/6).

6 Claims, 7 Drawing Sheets

U.S. PATENT DOCUMENTS

| | | | | |
|---|---|---|---|---|
| 6,960,140 | B2 * | 11/2005 | Solheim et al. | 473/251 |
| 6,966,845 | B2 * | 11/2005 | Solheim et al. | 473/251 |
| 7,048,639 | B2 * | 5/2006 | Grace | 473/251 |
| 7,134,970 | B2 * | 11/2006 | Lindsay | 473/313 |
| D533,243 | S * | 12/2006 | Fife et al. | D21/736 |
| 7,377,858 | B2 * | 5/2008 | Kubota | 473/251 |
| 7,387,580 | B2 * | 6/2008 | Hasegawa | 473/340 |
| 2002/0107086 | A1 | 8/2002 | Cameron | |
| 2003/0195053 | A1 | 10/2003 | Cameron | |
| 2003/0220150 | A1 * | 11/2003 | Takase | 473/251 |
| 2004/0063516 | A1 | 4/2004 | Cameron | |
| 2004/0132542 | A1 * | 7/2004 | Olsavsky et al. | 473/336 |
| 2004/0254028 | A1 | 12/2004 | Souza et al. | |
| 2004/0254029 | A1 | 12/2004 | Souza et al. | |
| 2005/0049078 | A1 | 3/2005 | Yamanaka et al. | |
| 2006/0019766 | A1 * | 1/2006 | Kubota | 473/340 |
| 2006/0094535 | A1 | 5/2006 | Cameron | |
| 2006/0128499 | A1 | 6/2006 | Yamanaka et al. | |
| 2006/0189408 | A1 * | 8/2006 | Grace | 473/340 |
| 2007/0149317 | A1 * | 6/2007 | Kubota | 473/340 |
| 2007/0243951 | A1 * | 10/2007 | Nishino | 473/340 |

FOREIGN PATENT DOCUMENTS

| | | | | |
|---|---|---|---|---|
| JP | 09000667 | A | * | 1/1997 |
| JP | 10127836 | A | * | 5/1998 |
| JP | 10192460 | A | * | 7/1998 |
| JP | 2000342727 | A | * | 12/2000 |
| JP | 2003339924 | A | * | 12/2003 |
| WO | WO 03068335 | | * | 8/2003 |
| WO | WO 2004035149 | A1 | * | 4/2004 |

* cited by examiner

PUTTER HEAD

This application claims priority on Patent Application No. 2006-113460 filed in JAPAN on Apr. 17, 2006. The entire contents of this Japanese Patent Application are hereby incorporated by reference.

BACKGROUND OF THE INVENTION

1. Field of the Invention

The present invention relates to a putter head.

2. Description of the Related Art

Conventionally known putter heads include pin type and L-shaped heads, generally referred to. Some of these putter heads may not be accompanied by sufficient moment of inertia, and may not have an enough sweet area. Therefore, these putter heads may vary in directionality upon mishitting. Also, so-called mallet putter heads may often have greater depth of the center of gravity and be accompanied by greater moment of inertia than pin type and L-shaped heads. However, even in the case of the mallet heads, improvement of the directionality of the hit ball may not be necessarily satisfactory.

In attempts to improve directionality of the hit ball, putter heads having a head shape which had not been suggested conventionally (hereinafter, may be also referred to as "head with changed shape") and having a large size have been proposed recently. This head with changed shape has a shape elongated in a face-to-back direction. This head with changed shape is also referred to as a modified mallet type. JP-A No. 2005-7172 discloses a putter head having an extremely great length in the face-to-back direction. JP-A No. 2003-210629 discloses a putter head having a weight member disposed at the posterior of the head. JP-A No. 2005-66249 discloses a putter head including a front half body made of a metal having a low specific gravity, and a rear half body made of a metal having a high specific gravity. Publication of United States Patent Application filed corresponding to JP-A No. 2005-7172 is US 2004/254028 A1. Publication of United States Patent Application filed corresponding to JP-A No. 2003-210629 is US 2002/0107086 A1. Publication of United States Patent Application filed corresponding to JP-A No. 2005-66249 is US 2005/0049078 A1 and US 2006/0128499 A1.

SUMMARY OF THE INVENTION

Due to the shape elongated in the face-to-back direction, the depth of the center of gravity is made greater, and a greater moment of inertia is achieved. However, when the head size is extremely large as in the head described in JP-A No, 2005-7172, difficulties associated with setting and swinging may be raised. Also, the heads made of different kinds of metals joined one another as in the case of the head described in JP-A Nos. 2003-210629 and 2005-66249 require higher production costs because they take a lot of time and effort to manufacture. In the head manufactured by joining the different kinds of metals, detachment may occur at the joint region during its use.

An object of the present invention is to provide a putter head which can achieve both a great moment of inertia and ease in setting, and which can be easily manufactured.

According to the present invention, a head having three regions, i.e., an anterior region positioned on the facemost side, a posterior region positioned on the backmost side, and a joint region positioned between the anterior region and the posterior region, which are provided to divide the putter head equally in the face-to-back direction, is envisaged. Herein, the anterior region has an anterior thick part having a thickness of equal to or greater than 20 mm. The joint region has a thin part having a thickness of equal to or less than 7 mm. The posterior region has a posterior thick part having a thickness of greater than 7 mm. The joint region has a full-width part formed by making the full width of this joint region to correspond to the thin part. Provided that the length of the head in the face-to-back direction is A1, the length of the full-width part in the face-to-back direction is equal to or greater than (A1/6).

Preferably, the length A1 of the head in the face-to-back direction is equal to or greater than 60 mm.

Preferably, the entire joint region is the thin part.

Preferably, maximum thickness T1 of the anterior region, maximum thickness T2 of the joint region, and maximum thickness T3 of the posterior region satisfy the relation: T1>T3>T2. Preferably, maximum width B1 of the anterior region, maximum width B3 of the joint region, and maximum width B6 of the posterior region satisfy the relation: B1>B6>B3.

Preferably, the weight of the posterior region is greater than the weight of the joint region.

According to the present invention, the weight is likely to be concentrated in the anterior region and the posterior region. Therefore, the moment of inertia and the depth of the center of gravity can be increased without excessively enlarging the head. Furthermore, the moment of inertia and the depth of the center of gravity can be increased without combining different kinds of metals having different specific gravities.

DESCRIPTION OF THE PREFERRED EMBODIMENTS

Hereinafter, the present invention will be explained in detail by way of preferred embodiments with appropriate reference to the accompanying drawings.

A Head 2 has a face surface 4, and a sole face 6. Furthermore, the head 2 has a hosel 8. This hosel 8 has a cylindrical shape. The hosel 8 forms an over hosel with a shaft not shown in the Figure. The hosel 8 is inserted into the pipe-shaped shaft, and the inner face of this shaft is adhered to the external face of the hosel 8 at the same time. The head 2 is attached to one end of the shaft not shown in the Figure, and a grip is attached to another end of this shaft, whereby a putter club (putter) is completed. In place of the hosel 8, a shaft hole may be provided. Also, in place of the hosel 8, a neck having a shaft hole may be provided.

A face insert f is provided on the face surface 4. The face insert f is a member separated from the head main body. The face insert f can improve feel at impact. The face insert f occupies a great part of the face surface 4. Illustrative examples of the material of the face insert f include aluminum, aluminum alloys, resins, elastomers, rubber and the like. Illustrative resins herein include polyurethane resins. By making the face insert f softer than the head main body, the feel at impact can be improved. Absence of the face insert f is also acceptable.

According to the present invention, an anterior region, a joint region and a posterior region are defined. On the assumption of the definition, toe-to-heel direction and face-to-back direction are defined. These and other terms used herein will be defined in the following.

Toe-to-Heel Direction

In a reference state in which a head is placed on a reference horizontal plane H1 at a predetermined lie angle and loft angle, a direction that is parallel to the face surface and that is parallel to the reference horizontal plane H1 may be defined as the toe-to-heel direction. When the predetermined lie angle is uncertain, the predetermined lie angle may be 71 degree. The lie angle of 71 degree is an average lie angle of general putter clubs. When the predetermined lie angle and loft angle are uncertain, the aforementioned reference state may be a steady state attained by allowing the head alone to be placed on the reference horizontal plane H1.

Face-to-Back Direction

In the reference state described above, a direction that is parallel to the reference horizontal plane H1 and that is perpendicular to the toe-to-heel direction may be defined as the face-to-back direction.

The length in the face-to-back direction from the facemost side position f1 to the backmost side position b1 in the face-to-back direction corresponds to the length A1 of the head 2 in the face-to-back direction.

First Plane P1 and Second Plane P2

Figure 1:
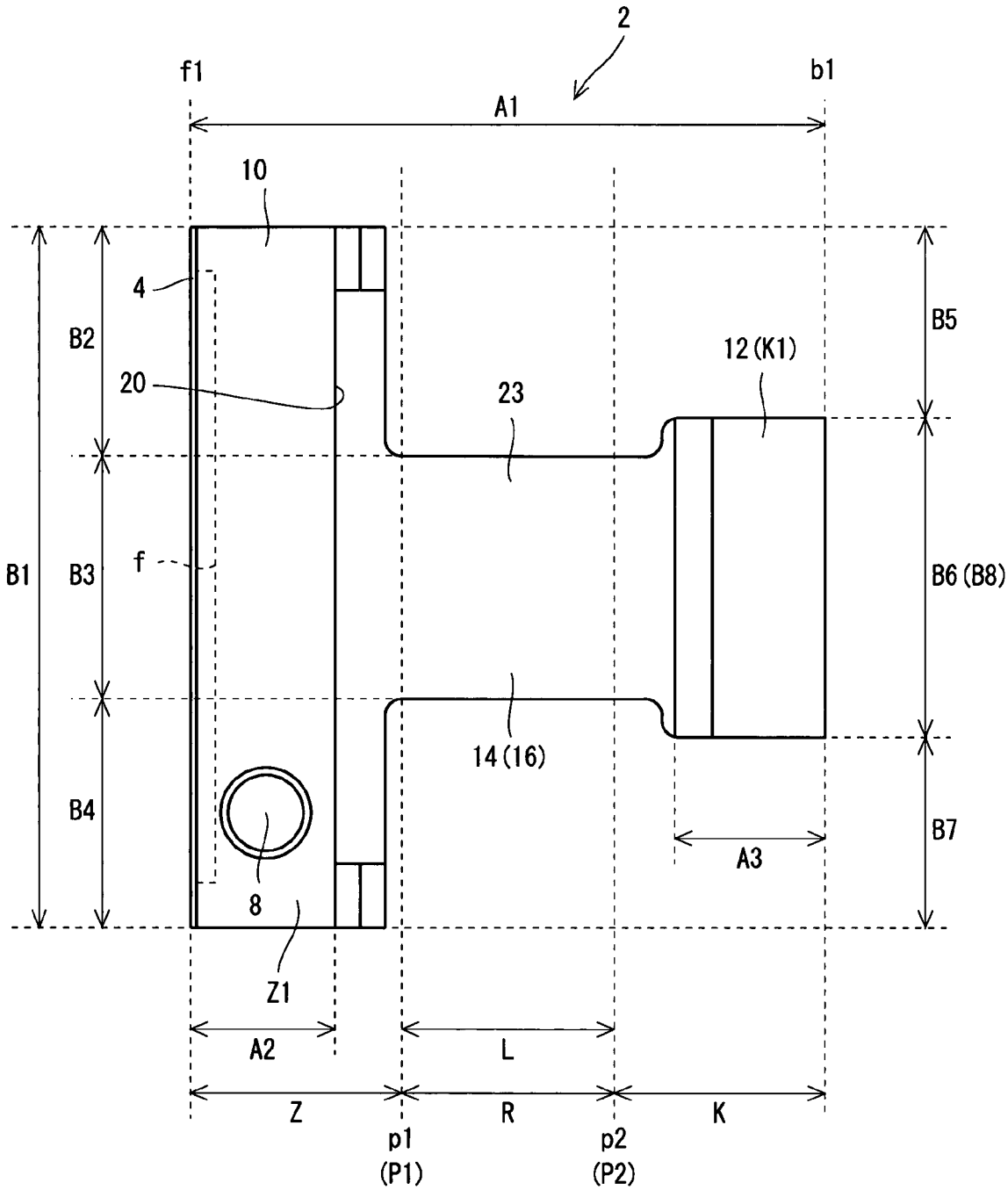
FIG. 1 shows a plan view of a putter head according to a first embodiment of the present invention viewed from the top side.
Figure 2:
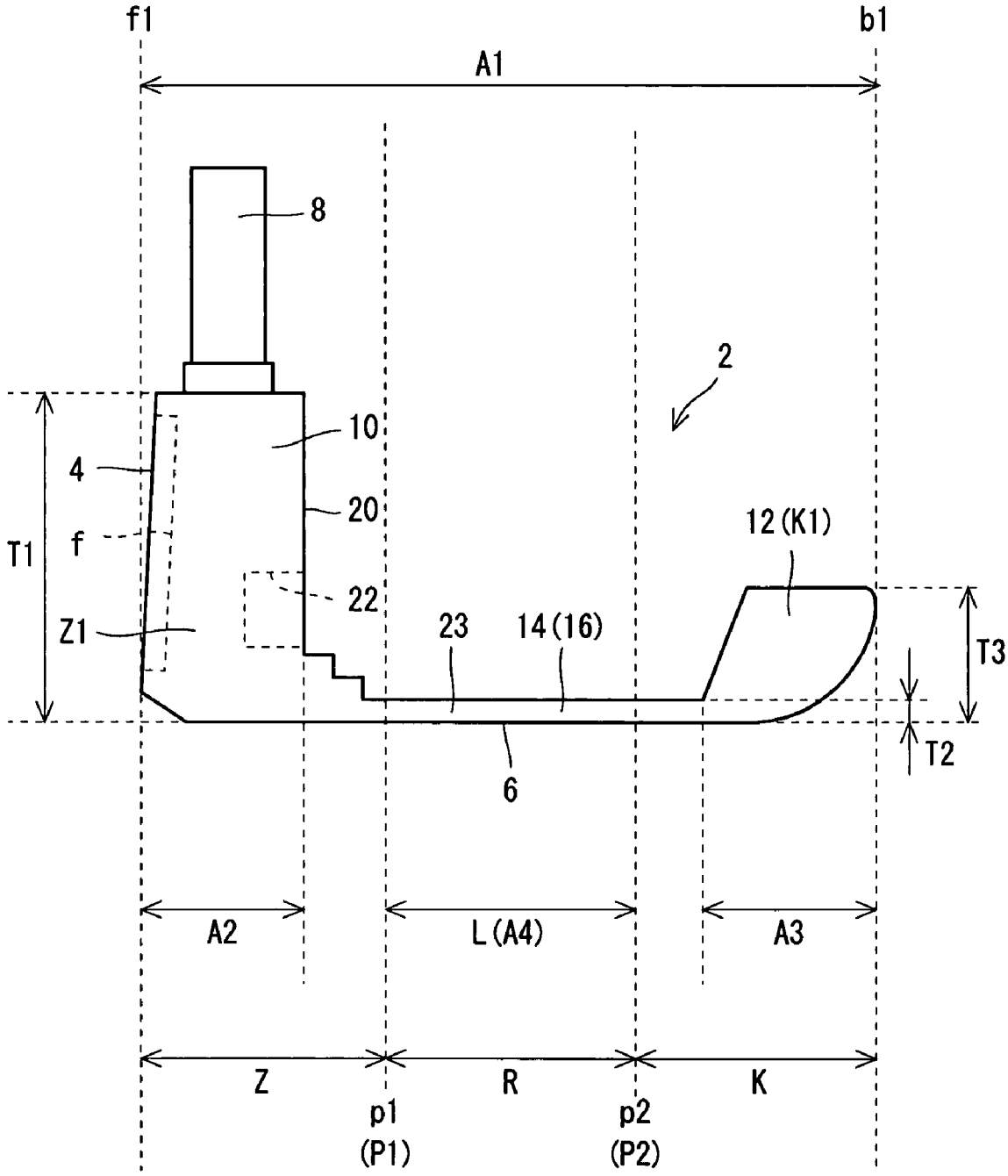
FIG. 2 shows a side view of the putter head shown in FIG. 1 viewed from the heel side.
Figure 3:
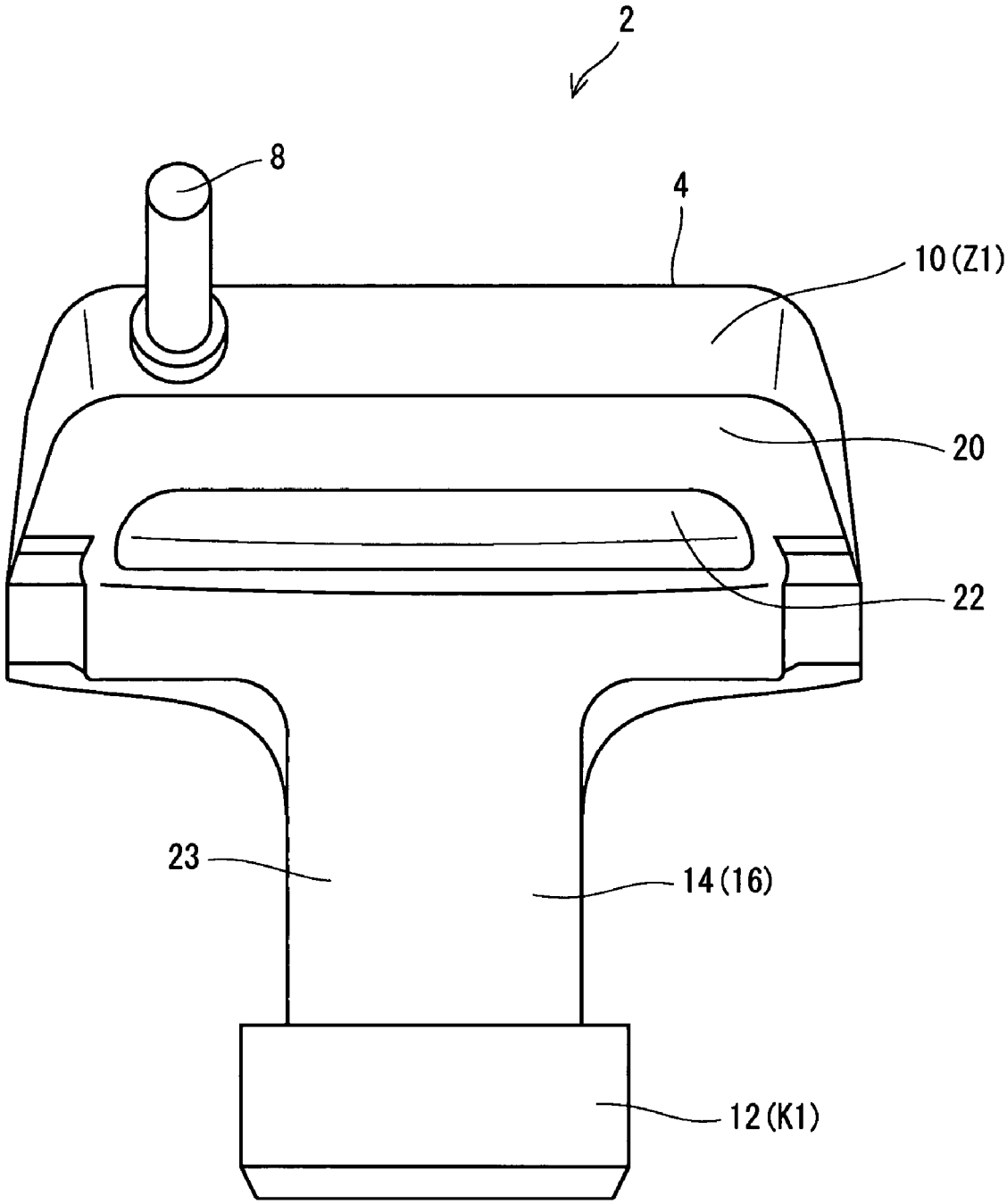
FIG. 3 shows a perspective view of the putter head shown in FIG. 1 viewed from the back side.

In this section, face-to-back directional positions p1, p2 are defined that equally divide the length A1 from the facemost side position f1 to the backmost side position b1. As shown in FIG. 1 and FIG. 2, the distance in the face-to-back direction from the facemost side position f1 to the position p1 is [(A1)/3]. The distance in the face-to-back direction from the facemost side position f1 to the position p2 is [(A1)×2/3]. The first plane P1 is a plane that is located on the position p1, and that is perpendicular to the face-to-back direction and is parallel to the toe-to-heel direction. The second plane P2 is a plane that is located on the position p2, and that is perpendicular to the face-to-back direction and is parallel plane to the toe-to-heel direction.

Anterior Region, Joint Region and Posterior Region The head 2 has three regions as comparted by the first plane P1 and the second plane P2. Among these, a part positioned on the facemost side is an anterior region Z, and a part positioned on the backmost side is a posterior region K. A part positioned between the anterior region Z and the posterior region K is a joint region R. The anterior region Z is a part on the face side from the first plane P1. The posterior region K is a part on the back side from the second plane P2. The joint region R is a part between the first plane P1 and the second plane P2.

Maximum Width and the like

Maximum length in the toe-to-heel direction in the anterior region Z is the maximum width B1 of the anterior region. Maximum length in the toe-to-heel direction in the joint region R is the maximum width B3 of the joint region R. Maximum length in the toe-to-heel direction in the posterior region K is the maximum width B6 of the posterior region K. Herein, the "width" means a length in the toe-to-heel direction.

Thickness

The "thickness" is measured in a direction that is perpendicular to the face-to-back direction, and is perpendicular to the toe-to-heel direction. In other words, the "thickness" is a thickness in the direction that is perpendicular to the reference horizontal plane H1. According to the present invention, the maximum thickness T1 of the anterior region Z, the maximum thickness T2 of the joint region R and the maximum thickness T3 of the posterior region K are defined (see, FIG. 2). The "thickness" is defined not to encompass the hosel 8 and the neck part. Also, the "thickness" is defined not to encompass any space. For example, when there are a hollow portion and a recessed part at a site where the thickness is measured, the hollow portion and the space formed with the recessed part are not involved in the "thickness".

The head 2 has a face part 10 including the face surface 4, an intermediate part 14 having a thickness of equal to or less than 7 mm, and a back part 12 that is thicker than this intermediate part 14. The intermediate part 14 has a substantially platy shape. The face part 10 is positioned on the face side of the intermediate part 14. The back part 12 is positioned on the back side of the intermediate part 14. The face part 10 is thicker than the intermediate part 14. The intermediate part 14 is provided between the face part 10 and the back part 12. The entirety of the face part 10 is included in the anterior region Z. The entirety of the back part 12 is included in the posterior region K. The intermediate part 14 occupies the entirety of the joint region R. The intermediate part 14 constructs a part of the anterior region Z. The intermediate part 14 constructs a part of the posterior region K.

The face part 10 has the face surface 4, and a face reverse surface 20 situated on the reverse side of the face surface 4. This face reverse surface 20 is provided with a recessed part 22.

Herein, a part having a thickness of equal to or less than 7 mm is defined as a "thin part". The joint region R has a thin part 16. In the head 2 of this embodiment, the thin part 16 occupies the entirety of the joint region R. By making the entirety of the joint region R to be the thin part 16, weight distribution to the joint region R is lessened. Lessening of the weight distribution to the joint region R can enhance the weight distribution to the anterior region Z and the posterior region K. Consequently, the moment of inertia and the depth of the center of gravity of the head can be increased. In addition, due to the thinness of the thin part, vibration of the head can be suppressed because the thin part itself vibrates. In other words, the thin part has a vibration absorption property. Due to the thin part having a vibration absorption property, the feel at impact is improved.

The anterior region Z has an anterior thick part Z1 having a thickness of equal to or greater than 20 mm. The posterior region K has a posterior thick part K1 having a thickness of equal to or greater than 7 mm.

In FIG. 2, what is indicated by a symbol A2 is the length of the face part 10 in the face-to-back direction. In FIG. 2, what is indicated by a symbol A3 is the length of the back part 12 in the face-to-back direction.

In the face part 10, the part where the recessed part 22 is present has a thickness of less than 20 mm. Therefore, the part where the recessed part 22 is present does not correspond to the anterior thick part Z1.

What is indicated by a symbol B2 in FIG. 1 is the width in the toe-to-heel direction of a part situated on the toe side from the intermediate part 14 in the face part 10. What is indicated by a symbol B4 in FIG. 1 is the width in the toe-to-heel direction of a part situated on the heel side from the intermediate part 14 in the face part 10. What is indicated by a symbol B5 in FIG. 1 is the width in the toe-to-heel direction of a part situated on the toe side from the back part 12 in the face part 10. What is indicated by a symbol B7 in FIG. 1 is the width in the toe-to-heel direction of a part situated on the toe side from the back part 12 in the face part 10. What is indicated by a symbol B8 in FIG. 1 is the width in the toe-to-heel direction of the back part 12. In the head 2, the maximum width B6 of the posterior region is equal to the width B8.

In the head 2, the maximum thickness T1 of the anterior region, the maximum thickness T2 of the joint region, and the maximum thickness T3 of the posterior region satisfy the relation: T1>T3>T2. Moreover, in the head 2, the maximum width B1 of the anterior region, the maximum width B3 of the joint region, and the maximum width B6 of the posterior region satisfy the relation: B1>B6>B3. By satisfying these relations, the weight becomes apt to be distributed to the anterior region Z and the posterior region K, whereby the moment of inertia of the head 2 can be elevated. By satisfying these relations, the weight becomes apt to be distributed to the posterior region K, whereby the depth of the center of gravity is increased.

The thin part 16 has a full-width part 23. The full-width part 23 is formed by making the full width of the joint region R to correspond to the thin part 16. The full-width part 23 has a thickness of equal to or less than 7 mm in all the positions in the toe-to-heel direction. In the cross section (not shown in the Figure) of the full-width part 23 along the face-to-back direction, there is not any part having a thickness greater than 7 mm. With respect to the length A1 of the head in the face-to-back direction, the length of the full-width part 23 in the face-to-back direction is equal to or greater than (A1/6). By providing the full-width part 23, the effect exhibited by providing the thin part 16 can be still further improved. Due to the full-width part 23, the weight distribution to the anterior region Z and the posterior region K is enhanced, and the effect of vibration absorption in the joint region R can be improved.

As described above, the entirety of the joint region R corresponds to the thin part 16 in the head 2. Therefore, the entirety of the joint region R corresponds to the full-width part 23. In the head 2, the length A4 of the full-width part 23 in the face-to-back direction is equal to the length L of the thin part in the face-to-back direction in the joint region.

Figure 4:
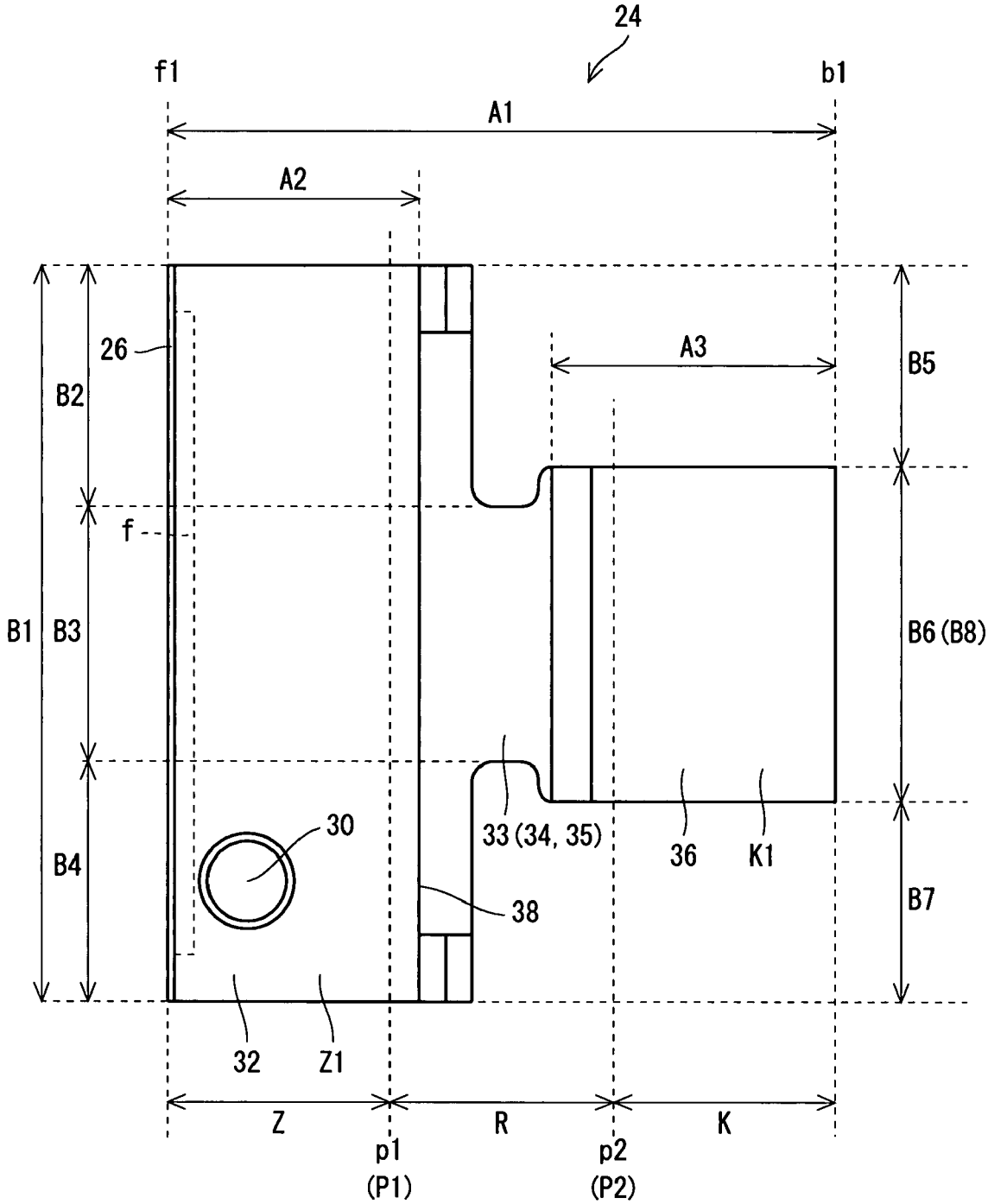
FIG. 4 shows a plan view of the putter head according to a second embodiment of the present invention viewed from the top side.
Figure 5:
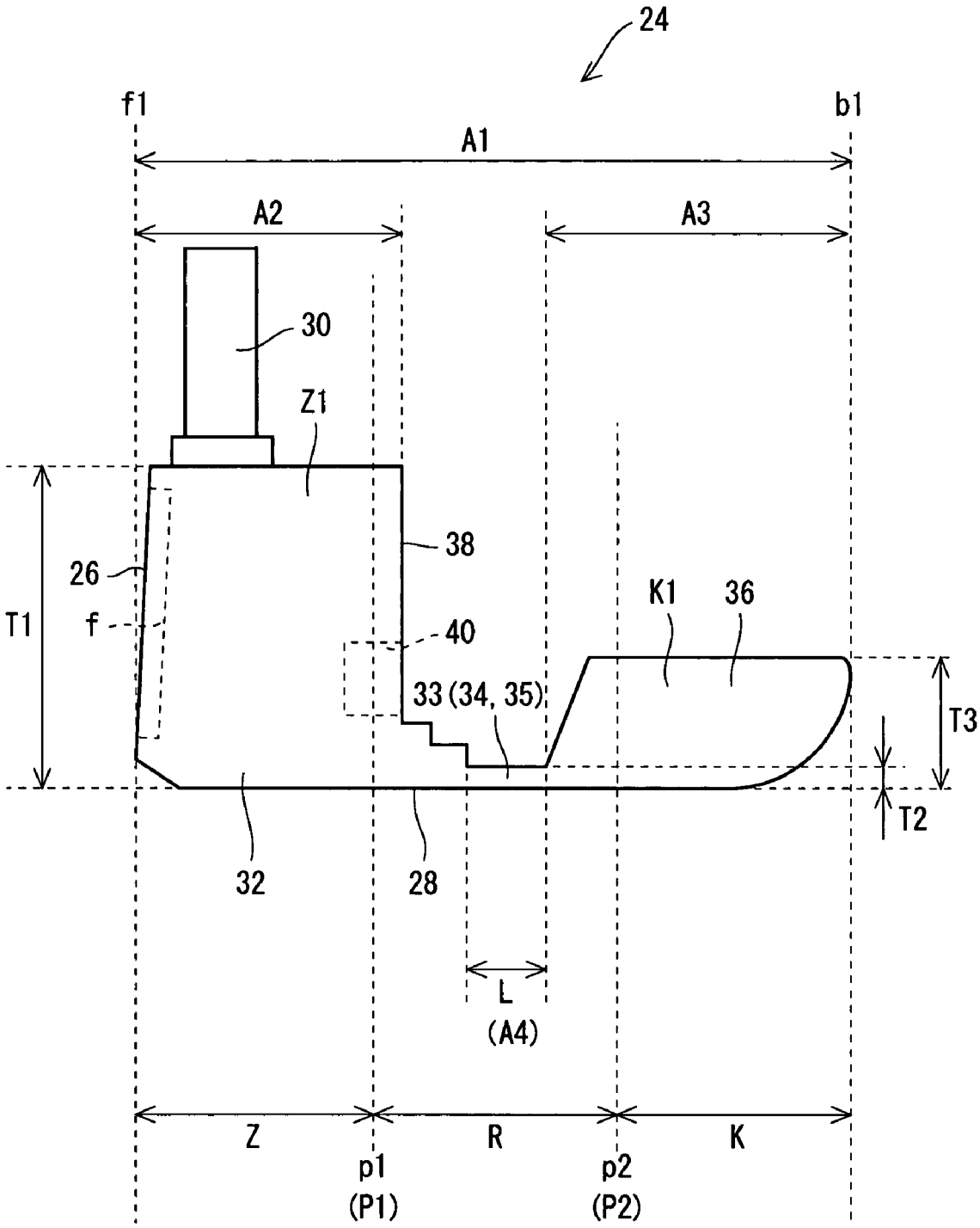
FIG. 5 shows a side view of the putter head shown in FIG. 4 viewed from the heel side.

FIG. 4 shows a plan view of the putter head 24 according to a second embodiment of the present invention viewed from the top side (above). FIG. 5 shows a side view of the head 24 viewed from the heel side.

The head 24 has a face surface 26, and a sole face 28. Also, the head 24 has a hosel 30. This hosel 30 has a cylindrical shape. The hosel 30 forms an over hosel with a shaft not shown in the Figure.

The head 24 has a face part 32 including the face surface 26, the intermediate part 34 having a thickness of equal to or less than 7 mm, and a back part 36 that is thicker than the intermediate part 34. The face part 32 is positioned on the face side of the intermediate part 34. The back part 36 is positioned on the back side of the intermediate part 34. The face part 32 is thicker than the intermediate part 34. The intermediate part 34 is provided between the face part 32 and the back part 36.

As compared with the head 2 according to the first embodiment, the head 24 has the length of the intermediate part 34 in the face-to-back direction even shorter than the length A1 of the head in the face-to-back direction. In the head 24, the entirety of the face part 32 is not included in the anterior region Z. The anterior region Z is constructed with the face part 32 alone. A part of the face part 32 constructs the joint region R. In other words, a back side part of the face part 32 is included in the joint region R. The entirety of the back part 36 is not included in the posterior region K. The posterior region K is constructed with the back part 36 alone. A part of the back part 36 constructs the joint region R. In other words, a face side part of the back part 36 is included in the joint region R. The intermediate part 34 does not occupy the entirety of the joint region R. The intermediate part 34 is provided only in the joint region R. The entirety of the intermediate part 34 constructs a part of the joint region R. The intermediate part 34 has a substantially platy shape.

The head 24 has a thin part 33. The thin part 33 is provided on the intermediate part 34. The thin part 33 constructs a part of the joint region R. The thin part 33 is provided only in the joint region R. The head 24 has a full-width part 35. The thin part 33 entirely corresponds to the full-width part 35. The length A4 of the full-width part 35 in the face-to-back direction is equal to the length L of the thin part in the face-to-back direction in the joint region.

The face part 32 has the face surface 26, and a face reverse surface 38 positioned on the reverse side of this face surface 26. This face reverse surface 38 is provided with a recessed part 40 (see, FIG. 5).

The anterior region Z has an anterior thick part Z1 having a thickness of equal to or greater than 20 mm. The posterior region K has a posterior thick part K1 having a thickness of equal to or greater than 7 mm.

Figure 6:
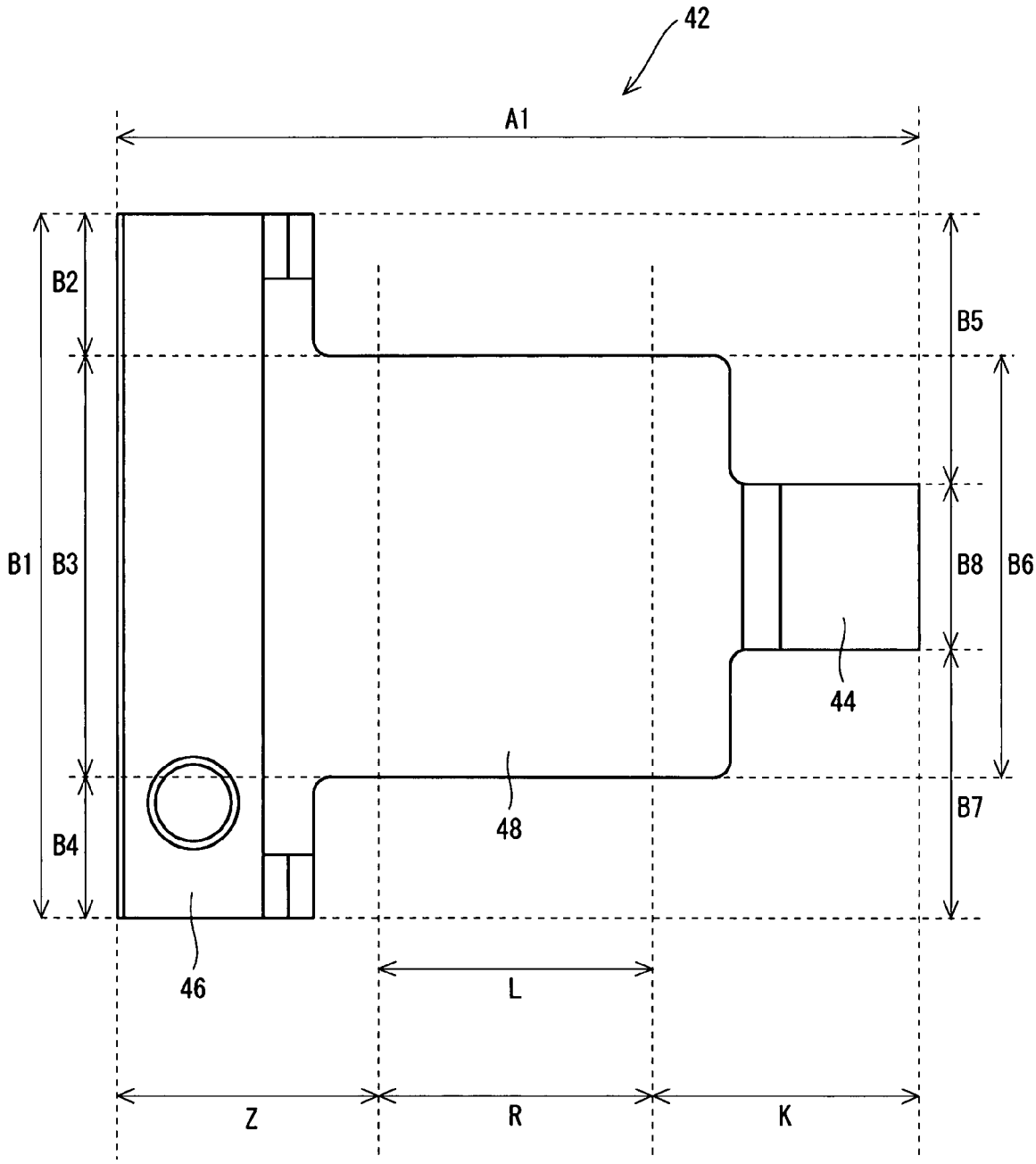
FIG. 6 shows a plan view of a putter head according to a third embodiment of the present invention viewed from the top side.
Figure 7:
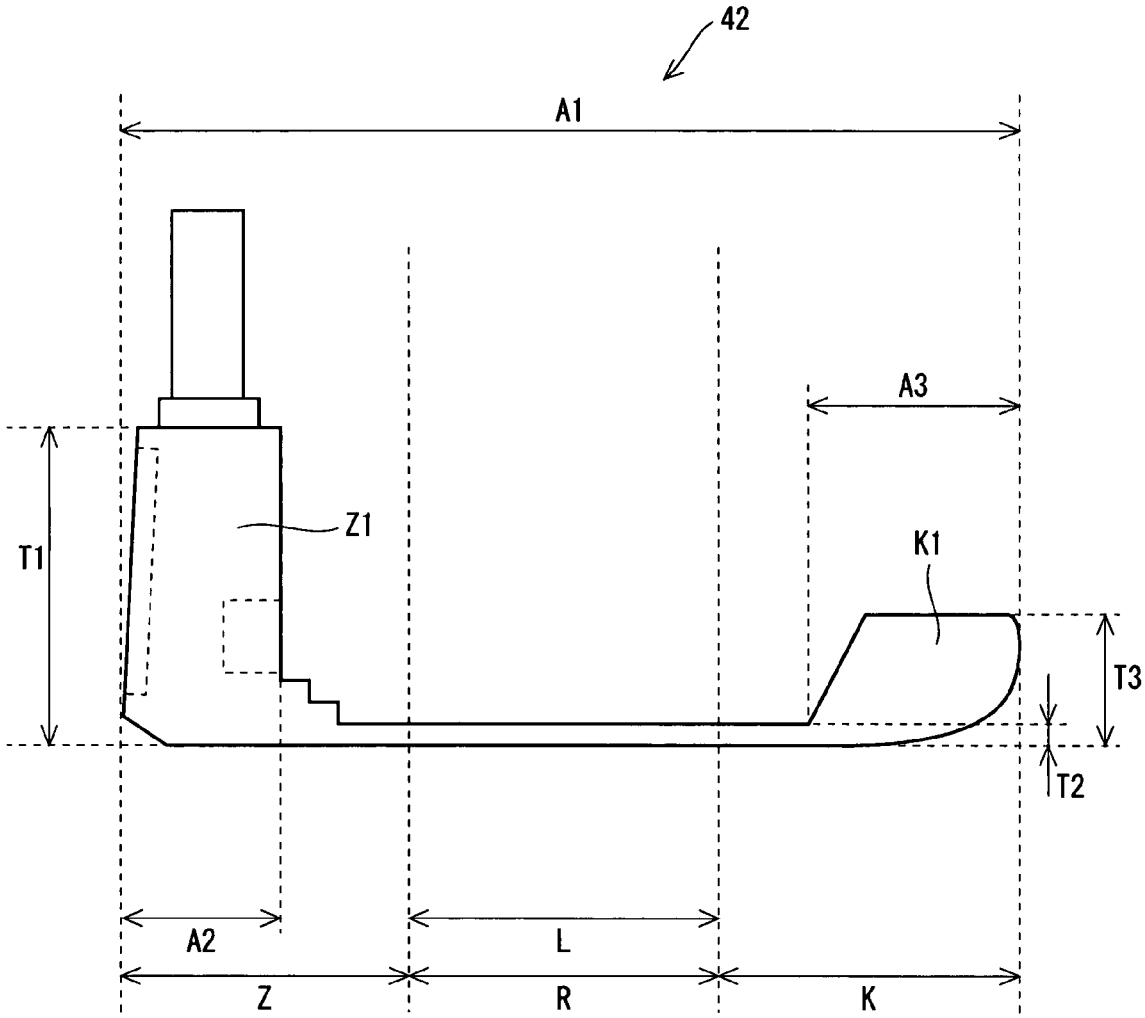
FIG. 7 shows a side view of the putter head shown in FIG. 6 viewed from the heel side.

According to the present invention, size of the face part, the back part and the intermediate part is not particularly limited. According to the present invention, magnitude correlation of the size of the face part, the back part and the intermediate part is not particularly limited. FIG. 6 and FIG. 7 show views of the putter head 42 according to the third embodiment of the present invention. The head 42 has a face part 46, an intermediate part 48 and a back part 44. The intermediate part 48 occupies the entirety of the joint region R, and further occupies a part of the anterior region Z and a part of the posterior region K. In this head 42, the maximum width B3 of the joint region is equal to the maximum width B6 of the posterior region. Moreover, the maximum width B6 of the posterior region is greater than the width B8 of the back part 44. Additionally, the maximum width B3 of the joint region is grater than the width B8 of the back part 44. The head according to the present invention may have a shape like, for example, the head 42.

The material of the head according to the present invention is not particularly limited. Illustrative examples of the material of the head include stainless (specific gravity: 7.8), pure titanium (specific gravity: 4.7), titanium alloys (specific gravity: approximately 4.4 to 4.8), aluminum or aluminum alloys (specific gravity: approximately 2.7), copper (specific gravity: 8.9), brass (specific gravity: 8.4), and soft iron (specific gravity: 7.9). Examples of the stainless include SUS304 and SUS630.

Method of manufacturing the head according to the present invention is not limited. The head according to the present invention can be produced by casting, forging or the like. The head according to the present invention may be formed by: integral molding of the entirety thereof; welding of multiple members; or adhering multiple members. The head according to the present invention is preferably formed by integral molding, except for the face insert f. According to the present invention, the magnitude of the moment of inertia and the depth of the center of gravity can be achieved without attaching any material having high specific gravity. The integrally molded head may reduce the amount of work such as welding and adhesion, and thus high productivity can be accomplished.

In light of prevention of the club weight from becoming too light, and stabilization of the swing, total head weight M is preferably equal to or greater than 300 g, more preferably equal to or greater than 315 g, and particularly preferably equal to or greater than 330 g. In light of suppression of difficulties in swing that may result from excessive club weight, the total head weight M is preferably equal to or less than 400 g, more preferably equal to or less than 385 g, and particularly preferably equal to or less than 370 g.

In light of enhancement of the weight distribution to the posterior region K and formation of a well-balanced head shape, the maximum thickness T2 of the joint region is preferably equal to or less than 7.0 mm, more preferably equal to or less than 6.0 mm, and particularly preferably equal to or less than 5.0 mm. In light of inhibition of defects in manufacture of the joint region to improve the production yield of the head, the minimum thickness of the joint region is preferably equal to or greater than 1.5 mm, more preferably equal to or greater than 1.8 mm, and particularly preferably equal to or greater than 2.0 mm.

When the impact point is below the sweet spot, favorable rolling can be achieved, thereby facilitating the ball getting in the cup. This event is caused on the ground that so called gear effect may prevent the ball from jumping up after the hitting, and may facilitate aptness of early rolling by overspin, and the like. In light of acceleration of the rolling by increasing probability of getting the impact point below the sweet spot, the face surface has a thickness of preferably equal to or greater than 20.0 mm, more preferably equal to or greater than 21.0 mm, and particularly preferably equal to or greater than 22.0 mm. When the distance between the impact point and the sweet spot becomes too large, deteriorated resilience performance may be achieved. In light of minimization of the distance between the impact point and the sweet spot, the face surface has a thickness of preferably equal to or less than 28.0 mm, more preferably equal to or less than 27.0 mm, and particularly preferably equal to or less than 26.0 mm.

In light of enhancement of the weight distribution to the posterior region K, and increase in the depth of the center of gravity, the maximum thickness T3 of the posterior region is preferably equal to or greater than 7.0 mm, more preferably equal to or greater than 8.0 mm, still more preferably equal to or greater than 9.0 mm, and particularly preferably equal to or greater than 10.0 mm. In light of ease in address (ease in setting), the maximum thickness T3 of the posterior region is preferably less than the maximum thickness T1 of the anterior region. In light of ease in address, the maximum thickness T3 of the posterior region is preferably equal to or less than 25 mm, more preferably equal to or less than 22 mm, and particularly preferably equal to or less than 20 mm.

In light of increase in the depth of the center of gravity, the length of the joint region R in the face-to-back direction is preferably equal to or greater than 20 mm, more preferably equal to or greater than 25 mm, and particularly preferably equal to or greater than 30 mm. When the length A1 of the head in the face-to-back direction is excessively great, physical disorder feeling is easily raised in terms of the head shape, whereby difficulties in setting may be involved. In light of improvement of durability of the joint region R, and inhibition of excessive increase in the length A1, the length of the joint region R in the face-to-back direction is preferably equal to or less than 60 mm, more preferably equal to or less than 55 mm, and particularly preferably equal to or less than 50 mm. The length of the joint region R in the face-to-back direction is (A1/3).

What is indicated by the symbol L in FIG. 1 and the like is the length of the thin part in the face-to-back direction in the joint region R. In the aforementioned head 2, the length L is equal to the length of the joint region R in the face-to-back direction. In the aforementioned head 24, the length L is shorter than the length of the joint region R in the face-to-back direction.

In light of lessening the weight distribution to the joint region R, and enhancement of the weight distribution to the anterior region Z and the posterior region K, the length L is preferably equal to or greater than 10 mm, more preferably equal to or greater than 15 mm, and particularly preferably equal to or greater than 20 mm. The upper limit of the length L is equal to the length of the joint region R in the face-to-back direction. In other words, the upper limit of the length L is a value derived by dividing the length A1 by 3, i.e., (A1/3). As described above, this length L is preferably set to be the upper limit (A1/3).

In light of lessening the weight distribution to the joint region R, and enhancement of the weight distribution to the anterior region Z and the posterior region K, the length A4 of the full-width part in the face-to-back direction is preferably equal to or greater than (A1/6), more preferably equal to or greater than (A1/5), particularly preferably equal to or greater than (A1/4), and most preferably (A1/3).

In light of increase in the depth of the center of gravity, the length of the intermediate part in the face-to-back direction is preferably equal to or greater than 20 mm, more preferably equal to or greater than 25 mm, and particularly preferably equal to or greater than 30 mm. In light of improvement of durability of the joint region R, the length of the intermediate part in the face-to-back direction is preferably equal to or less than 60 mm, more preferably equal to or less than 55 mm, and particularly preferably equal to or less than 50 mm.

In light of enhancement of the weight distribution to the anterior region Z, the length A2 of the face part in the face-to-back direction is preferably equal to or greater than 15 mm, more preferably equal to or greater than 17 mm, and particularly preferably equal to or greater than 20 mm. In light of inhibition of excessive weight distribution to the anterior region Z, the length A2 is preferably equal to or less than 35 mm, more preferably equal to or less than 33 mm, and particularly preferably equal to or less than 30 mm.

In light of enhancement of the weight distribution to the posterior region K, the length A3 of the back part in the face-to-back direction is preferably equal to or greater than 15 mm, more preferably equal to or greater than 17 mm, and particularly preferably equal to or greater than 20 mm. In light of inhibition of excessive weight distribution to the posterior region K, the length A3 is preferably equal to or less than 35 mm, more preferably equal to or less than 33 mm, and particularly preferably equal to or less than 30 mm.

When the recessed part provided on the face reverse surface belongs to the anterior region Z, this recessed part can moderate the excessive weight distribution to the anterior region Z. Such moderation can enhance the weight distribution to the posterior region K. Enhancement of the weight distribution to the posterior region K can increase the moment of inertia and the depth of the center of gravity. When the recessed part provided on the face reverse surface belongs to the joint region R, this recessed part can lessen the weight distribution to the joint region R, and enhance the weight distribution to the anterior region Z and the posterior region K.

In light of improvement of durability of the joint region, the minimum width of the joint region is preferably equal to or greater than 20 mm, more preferably equal to or greater than 25 mm, and particularly preferably equal to or greater than 30 mm. In light of inhibition of the weight distribution to the joint region, the maximum width B3 of the joint region is preferably equal to or less than 60 mm, more preferably equal to or less than 55 mm, and particularly preferably equal to or less than 50 mm.

In light of increase in the moment of inertia and the sense of relief at address, the maximum width B1 of the anterior region is preferably equal to or greater than 70 mm, more preferably equal to or greater than 80 mm, and particularly preferably equal to or greater than 90 mm. In light of suppression of excessive increase in the total head weight M, and ease in address, the maximum width B1 of the anterior region is preferably equal to or less than 140 mm, more preferably equal to or less than 130 mm, and particularly preferably equal to or less than 120 mm.

In light of elicitation of the effect by the weight distribution to the anterior region Z and the posterior region K, the length A1 of the head in the face-to-back direction is preferably equal to or greater than 60 mm, more preferably equal to or greater than 70 mm, and particularly preferably equal to or greater than 80 mm. In light of suppression of difficulties in address due to excessive enlargement of the head, the length A1 is preferably equal to or less than 130 mm, more preferably equal to or less than 120 mm, and particularly preferably equal to or less than 110 mm.

In light of enhancement of the weight distribution to the posterior region K, the maximum width B6 of the posterior region is preferably equal to or greater than 25 mm, more preferably equal to or greater than 30 mm, and particularly preferably equal to or greater than 35 mm. Upon the swing, a centrifugal force acts on the center of gravity of the head. Due to this centrifugal force, the head can incline so that the loft angle becomes great. This inclination is likely to be greater as the depth of the center of gravity is greater. In light of suppression of excessive increase in the depth of the center of gravity, and inhibition of excessive increase in the loft angle at impact, the maximum width B6 of the posterior region is preferably equal to or less than 70 mm, more preferably equal to or less than 60 mm, and particularly preferably equal to or less than 50 mm.

In light of improvement of the stability of the head in the stroke, and upgrading the directionality of the hit ball, the left-to-right moment of inertia of the head is preferably equal to or greater than 3000 ($g \cdot cm^2$), more preferably equal to or greater than 3500 ($g \cdot cm^2$), and particularly preferably equal to or greater than 4000 ($g \cdot cm^2$). Also, taking into consideration of preferred range of the total head weight M, the left-to-right moment of inertia of the head is usually equal to or less than 6000 ($g \cdot cm^2$). The left-to-right moment of inertia refers to a moment of inertia around an axis that passes the center of gravity of the head, and that is perpendicular to the toe-to-heel direction and is perpendicular to the face-to-back direction.

In light of increase in the depth of the center of gravity and broadening of the sweet area, the proportion of the weight M3 of the posterior region to the total head weight M is preferably equal to or greater than 5.0%, more preferably equal to or greater than 7.0%, and particularly preferably equal to or greater than 10.0%. In light of suppression of excessive increase in the depth of the center of gravity, and inhibition of excessive increase in the loft angle at impact, the proportion of the weight M3 of the posterior region to the total head weight M is preferably equal to or less than 30.0%, more preferably equal to or less than 25.0%, and particularly preferably equal to or less than 20%.

EXAMPLES

Hereinafter, advantages of the present invention will be explained by way of Examples, however, the present invention should not be construed as being limited based on the description of the Examples.

Example 1

A head having a shape similar to that of the head 2 according to the aforementioned first embodiment was produced. With respect to the method of the manufacture, the process for producing the head main body was casting. The head main body refers to a part except for the face insert f in the head. The entirety of the head main body was integrally molded by casting. The material of the head main body was stainless (SUS304). The material of the face insert f was an aluminum alloy. The face insert f was adhered to the head main body by an adhesive. To the resulting head was attached a shaft and a grip to obtain a putter club according to Example 1.

Example 2

A head and a putter club according to Example 2 were obtained in a similar manner to Example 1 except that the thickness of the intermediate part was partially increased to provide a region not being the thin part in a part of the joint region R, and that the specifications of the head were as shown in Table 1 below.

Examples 3, 4

A head and a putter club according to Example 3 and Example 4 were obtained in a similar manner to Example 1 except that the specifications of the head were as shown in Table 1 below.

Comparative Example 1

A head and a putter club according to Comparative Example 1 were obtained in a similar manner to Example 1 except that the thickness of the entire intermediate part was increased to allow the thin part to be absent, and that the specifications of the head were as shown in Table 1 below.

Examples A, B

A head and a putter club according to Example A and Example B were obtained in a similar manner to Example 1 except that the shape of the head was the same as that of the head 24 according to the second embodiment, and that the specifications of the head were as shown in Table 1 below.

Comparative Example A

The shape of the head was similar to the head 24 according to the second embodiment except that the thickness of the entire intermediate part was increased to allow the thin part to be absent. In addition, specifications of the head were as shown in Table 1 below. A head and a putter club according to Comparative Example A were obtained in a similar manner to Example 1 except for these matters.

Evaluation 1: Rolling Distance

Ten golf players performed putting on the green aiming at a target point situated four meters away. Each golf player performed the putting intending that the ball was stopped at the target point. Each golf player first practiced with 10 balls, and then the measurement was carried out on 10 balls following the practice. A straight line S drawn between the ball position upon hitting and the target point was defined as the target direction. On each hit ball, the distance in the targeted direction between the ball stop point and the target point ball was measured. In any of the case in which the ball stopped at a point passed over the target point, and the case in which the ball stopped before the target point, the measurement value of the distance should be a value of +(plus). Mean value on 10 balls was determined, and then final mean value was calculated by averaging the resulting mean values for 10 golf players. With respect to Examples 1 to 4 and Comparative Example 1, a value derived by indexing with the final mean value of Comparative Example 1 assumed to be 100 is shown in Table 1 below in terms of "rolling distance". With respect to Examples A, B and Comparative Example A, a value derived by indexing with the final mean value of Comparative Example A assumed to be 100 is shown in Table 1 below in terms of "rolling distance". Smaller index of the "rolling distance" suggests more excellent distance performance. As the index of the "rolling distance" is smaller, more favorable result is suggested.

Evaluation 2: Rolling Direction

In concurrence with the "rolling distance" test described above, a "rolling direction" test was carried out. The distance between the stop point of the ball and the line S was measured on each hit ball as described above. In either case in which the ball was deviated off to the right or to the left, the measurement value of the distance should be a value of + (plus). Mean value on 10 balls was determined, and then final mean value was calculated by averaging the resulting mean values for 10 golf players. With respect to Examples 1 to 4 and Comparative Example 1, a value derived by indexing with the final mean value of Comparative Example 1 assumed to be 100 is shown in Table 1 below in terms of "rolling direction". With respect to Examples A, B and Comparative Example A, a value derived by indexing with the final mean value of Comparative Example A assumed to be 100 is shown in Table 1 below in terms of "rolling direction". Smaller index of the "rolling direction" suggests more excellent directionality, with less deviation to the right or the left. As the index of the "rolling direction" is smaller, more favorable result is suggested.

TABLE 1

Specifications and Evaluation Results of Examples and Comparative Example

| | Unit | Example 1 | Example 2 | Example 3 | Example 4 | Comparative Example 1 | Example A | Example B | Comparative Example A |
|---|---|---|---|---|---|---|---|---|---|
| Drawing viewed from above | — | FIG. 1 | FIG. 1 | FIG. 1 | FIG. 1 | FIG. 1 | FIG. 4 | FIG. 4 | FIG. 4 |
| Length L of thin part in the face-to-back direction in joint region | mm | 30 | 30 | 30 | 30 | 0 | 20 | 20 | 0 |
| Length A1 of head in the face-to-back direction | mm | 90 | 110 | 90 | 90 | 70 | 90 | 100 | 70 |
| Length A2 of face member in the face-to-back direction | mm | 25 | 25 | 25 | 15 | 25 | 35 | 40 | 30 |
| Length A3 of back part in the face-to-back direction | mm | 20 | 20 | 20 | 10 | 20 | 40 | 35 | 30 |
| Maximum width B1 of anterior region | mm | 105 | 120 | 105 | 105 | 75 | 105 | 105 | 75 |
| Width B2 | mm | 35 | 40 | 35 | 35 | 25 | 35 | 35 | 25 |
| Maximum width B3 of joint region | mm | 35 | 40 | 35 | 35 | 25 | 35 | 35 | 25 |
| Width B4 | mm | 35 | 40 | 35 | 35 | 25 | 35 | 35 | 25 |
| Width B5 | mm | 30 | 35 | 30 | 30 | 20 | 30 | 30 | 20 |
| Maximum width B6 of posterior region | mm | 45 | 50 | 45 | 45 | 35 | 45 | 45 | 35 |
| Width B7 | mm | 30 | 35 | 30 | 30 | 20 | 30 | 30 | 20 |
| Maximum thickness T1 of anterior region | mm | 23 | 30 | 15 | 30 | 15 | 20 | 17 | 15 |
| Maximum thickness T2 of joint region | mm | 1.5 | 2.5 | 5 | 7 | 10 | 2.5 | 5 | 10 |
| Maximum thickness T3 of posterior region | mm | 15 | 10 | 10 | 20 | 12 | 10 | 8 | 12 |
| Weight M1 of anterior region | g | 250 | 270 | 200 | 250 | 160 | 260 | 260 | 200 |
| Weight M2 of joint region | g | 30 | 35 | 90 | 50 | 130 | 20 | 15 | 70 |
| Weight M3 of posterior region | g | 70 | 90 | 50 | 70 | 60 | 70 | 70 | 80 |
| Total head weight M | g | 350 | 395 | 340 | 370 | 350 | 350 | 345 | 350 |
| M3/M * 100 | % | 20.0 | 22.8 | 14.7 | 18.9 | 17.1 | 20.0 | 20.3 | 22.9 |
| Rolling distance | mm | 85 | 84 | 92 | 95 | 100 | 93 | 95 | 100 |
| Rolling direction | mm | 75 | 70 | 85 | 91 | 100 | 79 | 85 | 100 |

As shown in Table 1, Examples were more highly evaluated as compared with Comparative Examples. Accordingly, advantages of the present invention are clearly indicated by these results of evaluation.

The present invention can be applied to putter heads and putter clubs.

The description hereinabove is merely for an illustrative example, and various modifications can be made in the scope not to depart from the principles of the present invention.

What is claimed is:

1. A putter head comprising three regions: an anterior region positioned on the facemost side; a posterior region positioned on the backmost side; and a joint region positioned between the anterior region and the posterior region, which are provided to divide the putter head equally in the face-to-back direction, said anterior region having an anterior thick part having a thickness of equal to or greater than 20 mm, said joint region having a thin part having a thickness of equal to or less than 7 mm, said posterior region having a posterior thick part having a thickness of greater than 7 mm, said joint region having a full-width part formed by making the full width of this joint region to correspond to the thin part, and provided that the length of the head in the face-to-back direction is A1, the length of the full-width part in the face-to-back direction being equal to or greater than (A1/6).

2. The putter head according to claim 1 wherein the length A1 of the head in the face-to-back direction is equal to or greater than 60 mm.

3. The putter head according to claim 1 wherein the entire joint region is the thin part.

4. The putter head according to claim 1 wherein maximum thickness T1 of the anterior region, maximum thickness T2 of the joint region, and maximum thickness T3 of the posterior region satisfy the relation: T1>T3>T2.

5. The putter head according to claim 1 wherein maximum width B1 of the anterior region, maximum width B3 of the joint region, and maximum width B6 of the posterior region satisfy the relation: B1>B6>B3.

6. The putter head according to claim 1 wherein the weight of the posterior region is greater than the weight of the joint region.

* * * * *